US005213521A

United States Patent [19]

Arisaka

[11] Patent Number: 5,213,521

[45] Date of Patent: * May 25, 1993

[54] HIGH FREQUENCY ELECTRICAL CONNECTOR ASSEMBLY

[75] Inventor: Hiroshi Arisaka, Tokyo, Japan

[73] Assignee: Kel Corporation, Tokyo, Japan

[ * ] Notice: The portion of the term of this patent subsequent to Apr. 7, 2009 has been disclaimed.

[21] Appl. No.: 824,115

[22] Filed: Jan. 22, 1992

[30] Foreign Application Priority Data

Jan. 22, 1991 [JP] Japan ..... 3-20306

[51] Int. Cl.[5] ..... H01R 13/648

[52] U.S. Cl. ..... 439/608; 439/65; 439/47

[58] Field of Search ..... 439/45–48, 439/75, 92, 108, 109, 608; 174/267

[56] References Cited

U.S. PATENT DOCUMENTS

| | | | |
|---|---|---|---|
| 3,193,788 | 7/1965 | Brown | 439/46 |
| 3,656,090 | 4/1972 | McDonald et al. | 439/680 |
| 4,208,080 | 6/1980 | Teagno | 439/45 |
| 4,859,806 | 8/1989 | Smith | 439/75 |
| 5,102,352 | 4/1992 | Arisaka | 439/608 |

*Primary Examiner*—Larry I. Schwartz
*Assistant Examiner*—Hien D. Vu
*Attorney, Agent, or Firm*—Robert W. J. Usher

[57] ABSTRACT

A high frequency electrical connector assembly comprises first and second intermatable connectors including first and second intermatable housings, respectively, containing first and second board assemblies each comprising a series of conductive and insulating dielectric layers located alternately in overlying relation and extending transversely of a mating direction. Intermatable ground contacts extend between and interconnect all the conductive layers of respective board assemblies thereby forming ground planes, and, a first and second series of signal contacts having intermatable portions and anchoring portions extending through the respective board assemblies. The respective conductive layers extend to locations adjacent and spaced from the anchoring portions so that mating portions of the connector assembly are shieldingly enclosed between the board assemblies when the connectors are mated. The ground contacts are mating pin and socket portions or intermatable metal portions of the respective housings.

10 Claims, 13 Drawing Sheets

HIGH FREQUENCY ELECTRICAL CONNECTOR ASSEMBLY

Reference is made to copending application No. 07/641757 filed Jan. 17, 1991.

FIELD OF THE INVENTION

The invention relates to an electrical connector assembly comprising matable electrical connectors suitable for transmitting high frequency signals.

BACKGROUND OF THE INVENTION

The very substantial increase in clock frequencies of central computer and processing devices in recent years together with the manyfold increase in data processing speeds and the requirement for transmitting much increased quantities of data have produced a commensurate need to increase signal transmission speed and to transmit a series of signals in parallel. In addition, the inexorable trend to miniaturization also dictates that electrical connectors for such applications have large numbers of densely packed signal contacts.

However, with increasing signal speed "cross-talk" between adjacent signal contacts increases creating noise which causes erroneous operation.

There is, therefore, a requirement for an electrical connector incorporating means for keeping cross-talk to an acceptably low level while transmitting high-speed signals.

One example of a known connector assembly is disclosed in Japanese patent publication 2-223172 and shown in FIGS. 13(*a*) and 13(*b*) which are schematic perspective views of a pair of shielded connectors for transmitting data at high speed.

In first and second connectors 10 and 20, first signal contacts 11 and 21, respectively, are mounted in housings 1 and 2, respectively, surrounded by first and second tubular ground contacts 12 and 22, the latter being enclosed by a dielectric 23, such as a TEFLON (trademark). On mating the connectors 10 and 20, first and second signal contacts 11 and 21 and first and second ground contacts 12 and 22, respectively, are connected with the mating parts of the first and second signal contacts enclosed and shielded by the first and second tubular ground contacts, preventing cross-talk.

However, the requirements for the connectors to be multi-pin, but also miniaturized are inherently conflicting as such necessitates a large number of signal contacts to be arrayed at extremely small pitch for example 1 mm while being enclosed by the tubular ground contacts which are also extremely small and must therefore be manufactured to high tolerances, while, additionally, the dielectric 23 must also be extremely small and precisely dimensioned.

In practice, it is very difficult to adhere to such high manufacturing tolerances in the mass production environment, with the result that the connectors are produced in undesirably large sizes.

SUMMARY OF THE INVENTION

An object of this invention is to provide an electrical connector in which the cross-talk is reduced sufficiently or acceptable transmission of signals at high speed and which is also adapted for miniaturization.

According to one aspect of the invention a high frequency electrical connector assembly comprises first and second intermatable connectors including first and second housings, respectively, having complementary front mating faces for movement together in a mating direction into mating engagement, first and second board assemblies mounted in the first and second housings, respectively, and each comprising a series of conductive and insulating dielectric layers located alternately in overlying relation and extending transversely of the mating direction, first and second, intermatable ground contact means extending between and interconnecting all the conductive layers of respective board assemblies thereby forming ground planes, and, a first and second series of signal contacts having complementary mating portions and anchoring portions extending through the respective board assemblies with the complementary mating portions at the mating faces and the respective conductive layers extending to locations adjacent and spaced from the anchoring portions so that mating portions of the connector assembly are shieldingly enclosed between the board assemblies when the connectors are assembled together.

Thus, the prior, complex structure in which the individual signal contacts were enclosed by respective tubular ground contacts is avoided by the invention, enabling an electrical connector having many signal contacts arrayed at a close pitch of about 1 mm to be manufactured, while the cross-talk is sufficiently small for the transmission of high frequency signals of, for example, 500 MHZ or less.

Furthermore, during manufacture, impedance matching can be performed by selecting individual thicknesses for the dielectric layers and suitable distances between the signal contacts and the productive layers. As the grounded conductive layers extend to locations adjacent the signal contacts, "skew", a phenomenon in which the synchronicity of the signals transmitted through a series of signal contacts is lost, which may arise where, for example only one ground pin is provided, (on an end of the electrical connector,) is avoided, even though the distances between the ground pin and the individual signal contacts would then differ.

In one embodiment, at least one of the first and second connectors has a rear, printed circuit board mounting face and at least some of the signal contacts of said at least one of the first and second connectors have printed circuit board engaging portions extending to the printed circuit board mounting face.

Preferably, conductive layers form outermost, front and rear layers of the board assemblies and an insulating cover may overlie an outermost conductive layer at the mating face.

The first and second ground contact means may have respective conductive layer contacting portions anchored in the first and second board assemblies, respectively, and matable male and female portions at respective mating faces.

The ground contact means may be anchored in the board assembly only on opposite transverse sides of the signal contacts.

In one embodiment the ground contact means includes first and second housing portions of conductive material extending rearwardly from mating faces around peripheral side edges of respective board assemblies in electrical contact with respective conductive layers thereof to provide a ground shielding layer. More particularly, one housing has mating portions extending forwardly at the mating face which together with said rearwardly extending portions are made of conductive material. This ensures that the mating portions of the contacts are completely surrounded by shielding.

More particularly, the ground contact means has mating portions may include a conductive layer covering peripheral side edges of the board assemblies thereby interconnecting the conductive layers of the board assemblies.

BRIEF DESCRIPTION OF THE DRAWINGS

Embodiments of the invention will now be described by way of example only with to the accompanying drawings in which.

DETAILED DESCRIPTION OF THE INVENTION

Figure 1:
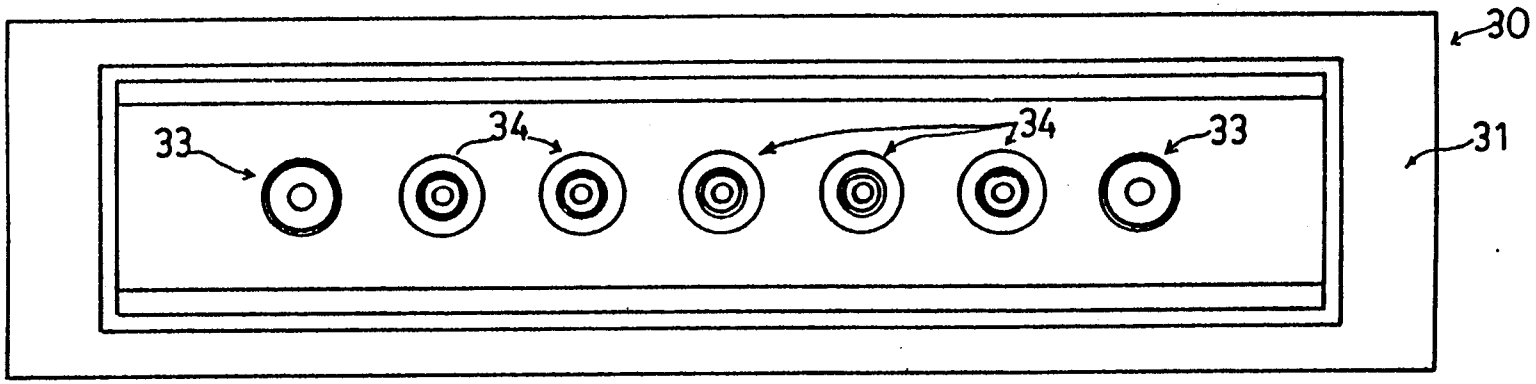
FIG. 1 is a plan view of a first embodiment of plug connector of the invention.
Figure 2:
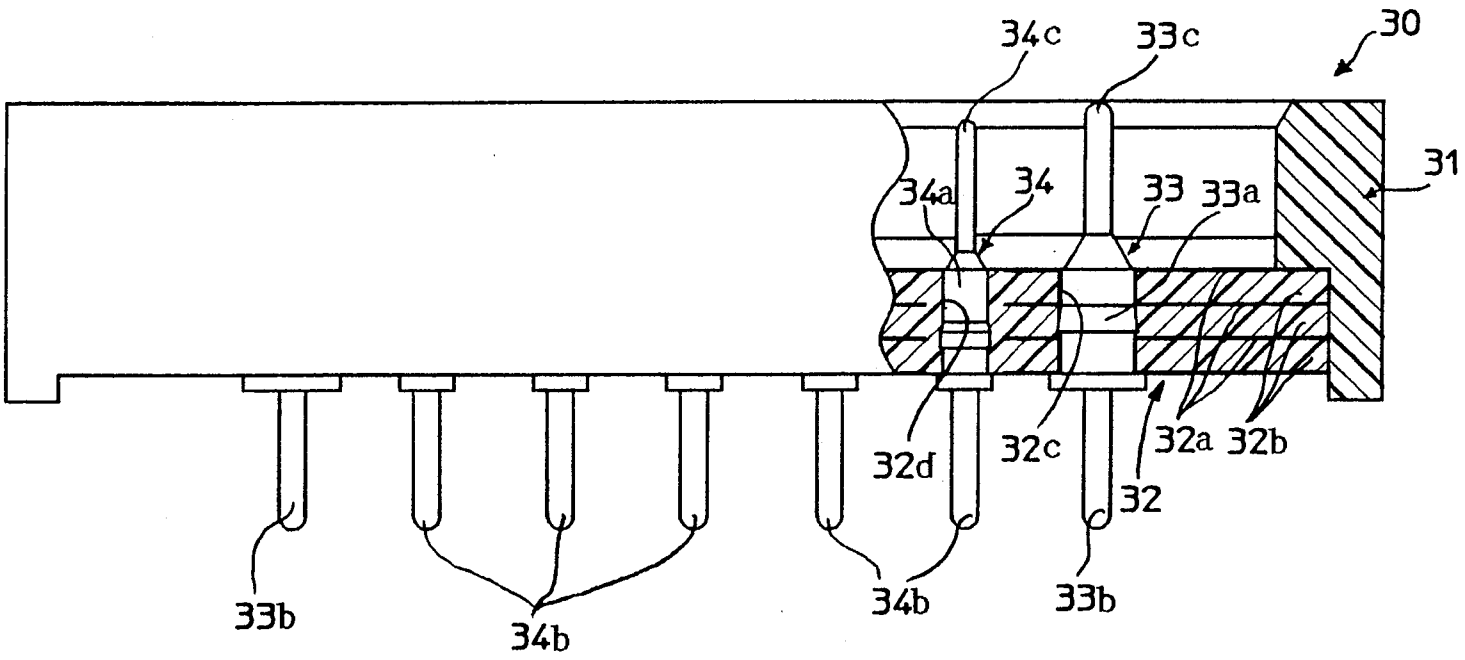
FIG. 2 is a side elevation, partly in cross-section along a longitudinal axes of the plug connector of FIG. 1.
Figure 3:
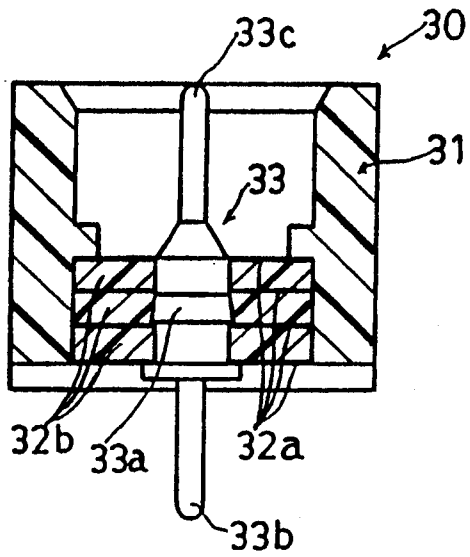
FIG. 3 is a cross-sectional view along a transverse axes of the plug connector of FIG. 1.

As shown in FIGS. 1–3, a first example of plug connector 30 comprises an insulating housing shell 31 having front, mating and rear, board engaging faces, in which is secured a base or board assembly 32 comprising four conductor plates 32*a* and three insulating dielectric plates 32*b* arranged in alternate, overlying layers extending transversely of a mating axis. The base or board assembly 32 may be manufactured using conventional multi-layer printed circuit board manufacturing techniques or, four separately formed conductor plates 32*a* and three separately formed dielectric boards 32*b* may be stacked and laminated.

Apertures 32*c* and 32*d* are preformed to extend axially through the board assembly. The conductor plates 32*a* extend to the their axial peripheries of apertures 32*c* which are lined throughout their axial length with conductive material connecting to all conductor plates. However, the conductor plates are terminated at locations adjacent but spaced from the apertures 32*d* so that they are electrically isolated therefrom.

Ground contacts 33 formed by metal pins have central anchoring portions 33*a* from respective opposite ends of which extend board connecting pin portions 33*b* and mating pin portions 33*c*. The anchoring portions are pushed into respective apertures 32*c* located adjacent respective longitudinal ends of the board assembly and received as force fits thereby connecting the ground contacts to respective conductor plates with the mating pin portions 33*c* extending axially forwardly at the front, mating face and the board connecting pin portions 33*b* extending axially from the rear face.

In an alternative method of interconnecting the ground contacts and the conductor plates 32*a*, the ground contacts 33 can be anchored in the base plate by a soldering step.

Signal contacts 34, formed by metal pins have central anchoring portions 34*a* from respective opposite ends of which extend board connecting pin portions 34*b* and mating pin portions 34*c*. Five signal contacts are pushed into undersized apertures 32*d* in the central area of the board assembly 32 securing their anchoring portions 34*a* therein spaced apart from and insulated from the conductor face 32*a*.

The pin portions 33*b* and 34*b*, of the ground contacts 33 and of the signal contacts 34, respectively, are inserted into apertures in a printed circuit board, (not shown) on which circuit elements have been mounted.

Figure 4:
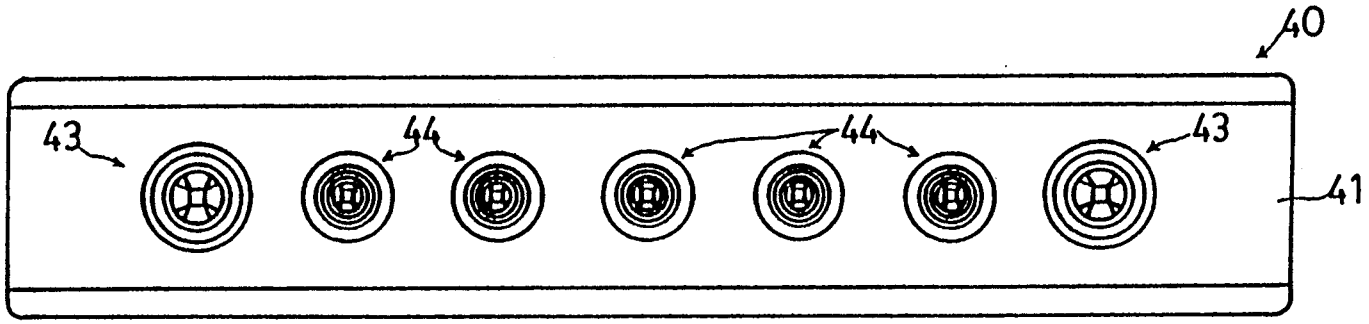
FIG. 4 is a plan view of a first embodiment of receptacle connector matable with the plug connector of FIG. 1.
Figure 5:
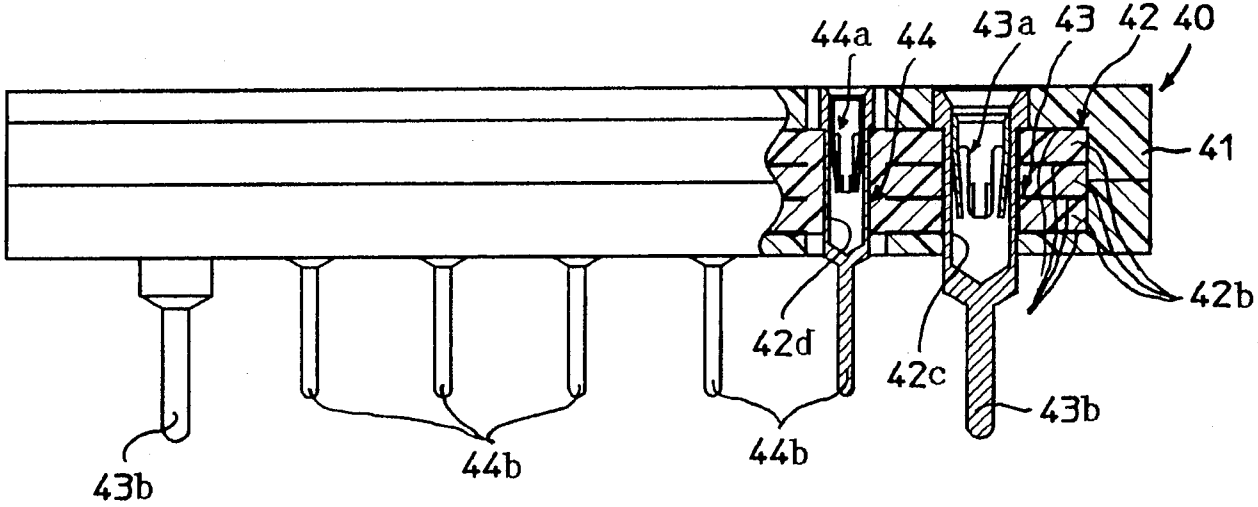
FIG. 5 is an elevational view, partly in longitudinal cross-section of the receptacle connector shown in FIG. 4.
Figure 6:
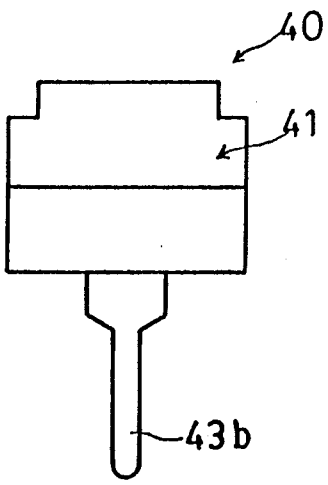
FIG. 6 is an end elevation of the receptacle connector of FIG. 4.

The receptacle connector 40, shown in FIGS. 4–6 is formed in an essentially similar manner as the plug connector 30, except that the shapes of the housing and contacts are different.

Four conductor plates 42*a* and three insulating dielectric plates 42*b* are laminated in alternate layers to form a base or board assembly 42 which is secured in an insulating housing 41 to extend transversely of a mating axis and located between front, mating and rear, board engaging faces of the housing.

Ground pins 43 have anchoring portions formed by female connecting portions 43*a* pushed or force-fitted into board assembly apertures 42*c*, (similarly formed to those of the board assembly of the plug connector, adjacent respective ends thereof), and five signal pins 44 each have anchoring portions provided by female mating portions 44*a* pushed or force-fitted into a more central area of the base plate 42. As with the plug connector, the apertures 42*c* are lined with a conductive layer which is continuous with the conductor plates 42*a* so that the ground pins 43 are electrically connected to the conductor plates 42*a* on insertion into the apertures 42*c*. Board connecting pin portions 43*b* and 44*b* of the ground contacts 43 and the signal contacts, 44, respectively, protrude from a rear, board engaging face for insertion into apertures in a printed circuit board (not shown) on which various circuit elements have been installed.

Figure 7:
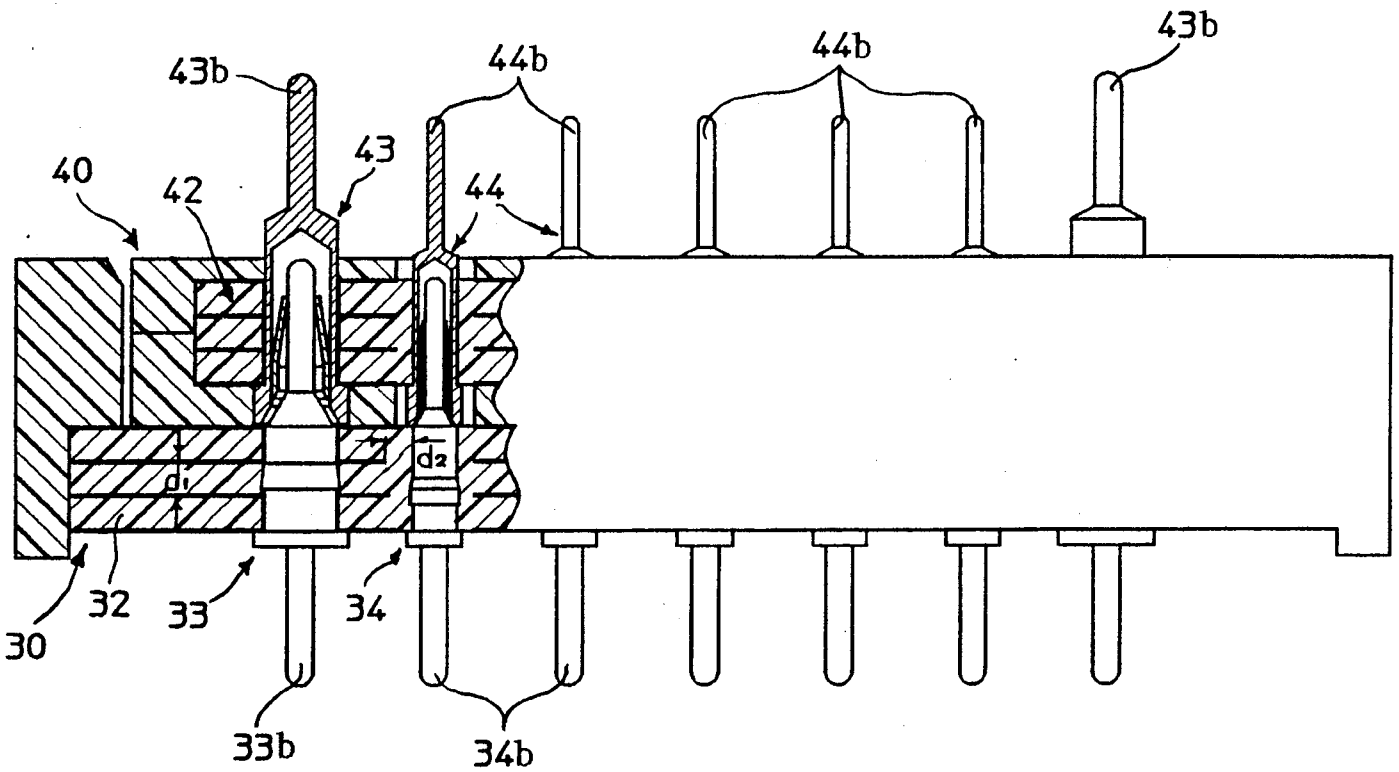
FIG. 7 is an elevational view, partly in cross-section, of the first embodiments of plug and receptacle connectors mated in a connector assembly.
Figure 8:
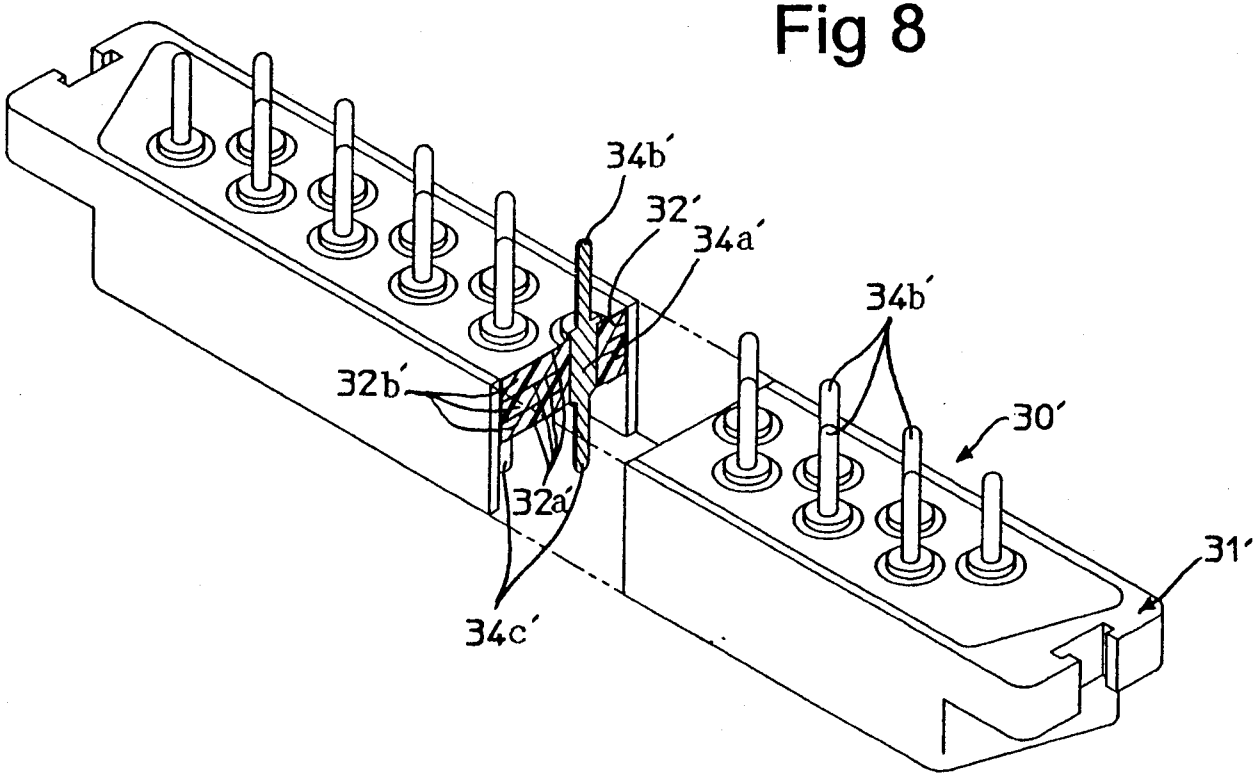
FIG. 8 is a perspective view, partly in cross-section, of a second embodiment of plug connector according to the invention.
Figure 9:
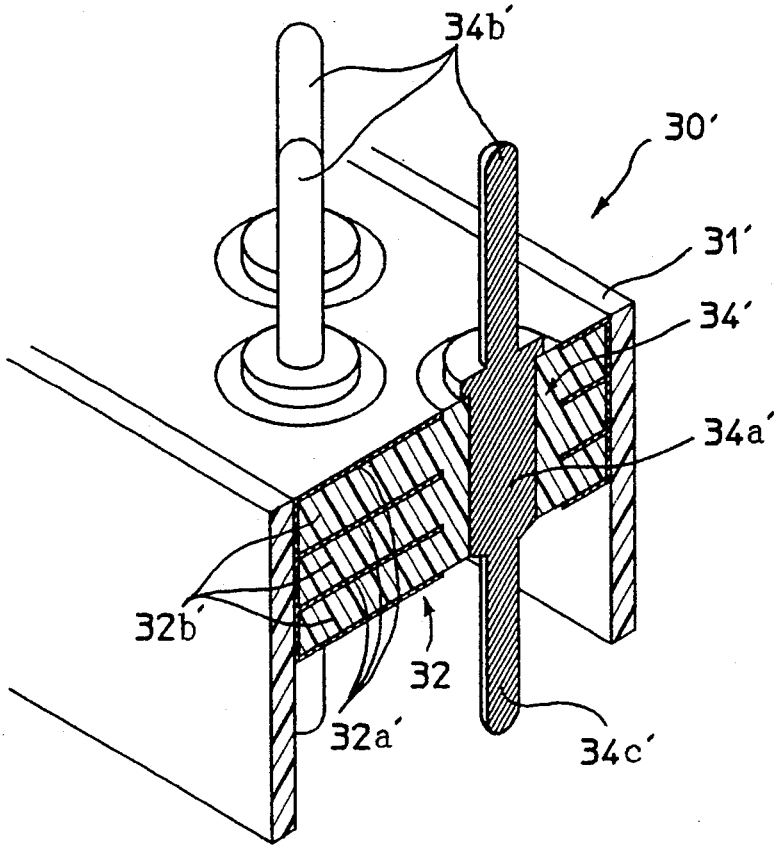
FIG. 9 is a fragmentary, perspective view, partly in cross-section, cross-sectional view of the connector of FIG. 8 at an increased scale.
Figure 10:
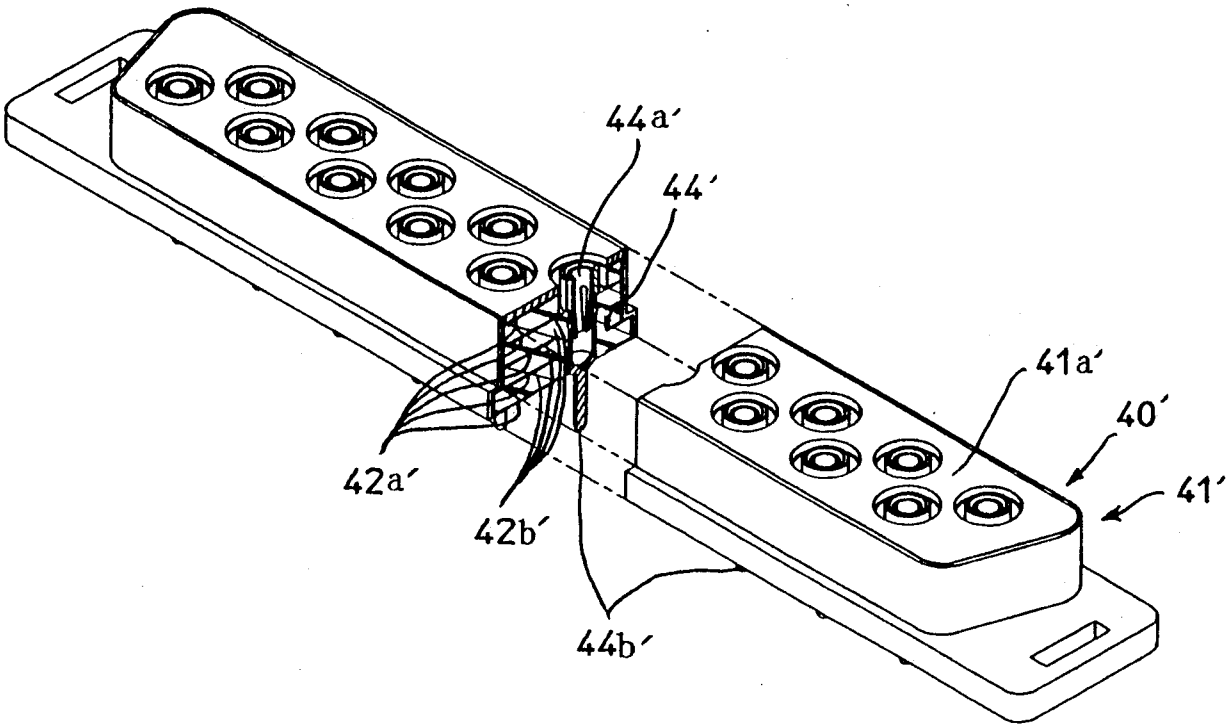
FIG. 10 is a perspective view, partly in cross-section of a second embodiment of receptacle connector according to the invention.
Figure 11:
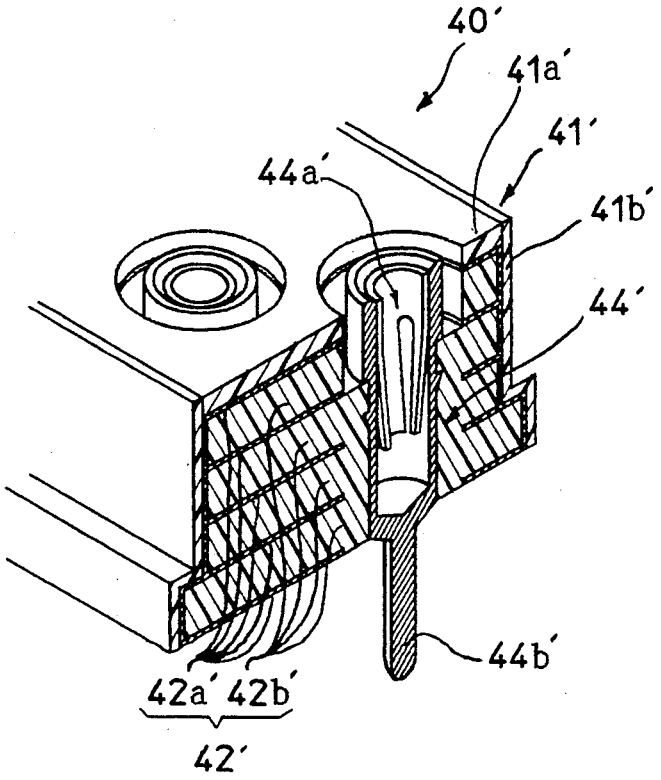
FIG. 11 is a fragmentary perspective view, partly in cross-section of the receptacle connector of FIG. 10 at a greater scale.
Figure 12:
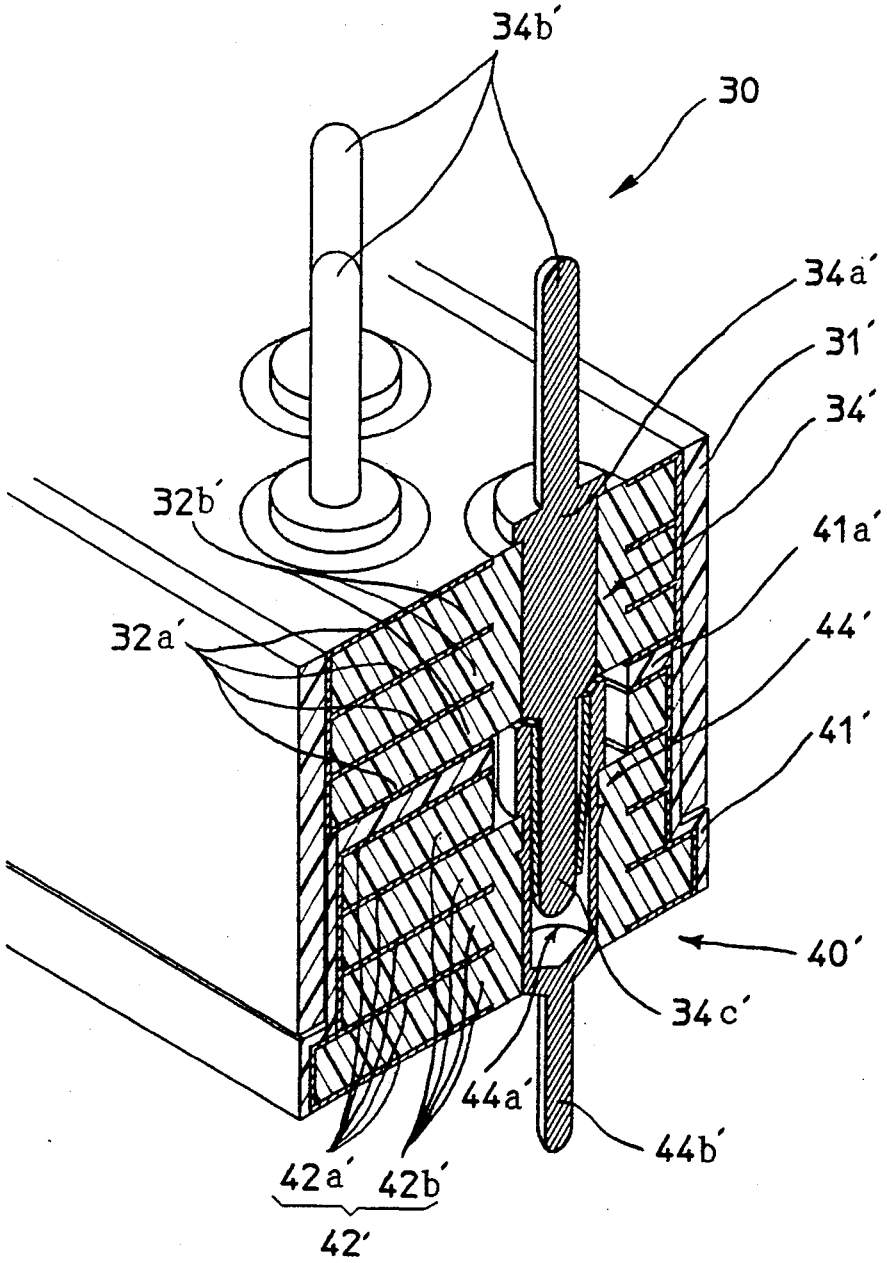
FIG. 12 is a fragmentary view, partly in cross-section of the second examples of plug and receptacle connectors mated together in a connector assembly; and, FIG. 13(*a*) and FIG. 13(*b*) fragmentary perspective views of conventional, matable electrical connectors.
Figure 13B:
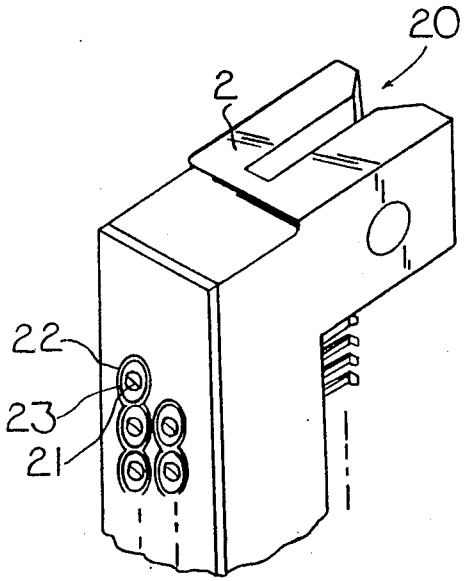
FIG 13B PRIOR ART
Figure 13A:
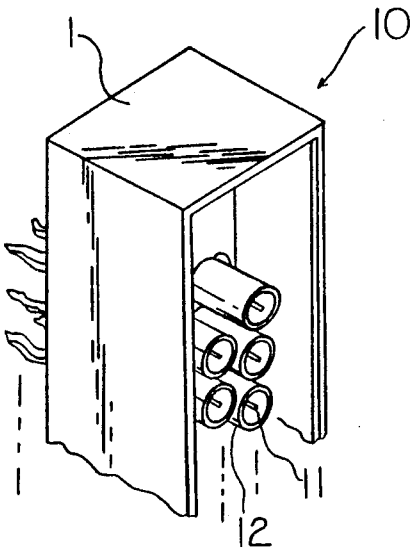
FIG 13A PRIOR ART

When the plug and receptacle connectors 30 and 40, respectively, are mated, the respective mating parts 34*c* and 44*a* and 33*c* and 43*a*, respectively, of the signal and ground contacts of the two connectors are electrically connected together with the mating parts of the signal contacts enclosed by the board assemblies 32 and 42, as shown in FIG. 7 and almost completely surrounded by the conductor layers 32*a* and 42*a* which enables crosstalk to be very much reduced in comparison with structures in which the conductor layers 32*a* and 42*a* are absent, enabling satisfactory, high frequency signal transmission.

As stated above, the board assemblies 32 and 42 can be made by the conventional procedures for multi-layer printed circuit boards or by perforating individual, separate conductor and dielectric plates and stacking them in alignment one on top of the other.

In such connectors, the signal contacts can be located at a very small pitch of, for example, 1 mm enabling miniaturization. Furthermore, by selecting suitable thicknesses d1 of the dielectric boards, plates or layers 32*b* and 42*b*, the number of conductor plates or layers 32*a* or 42*a*, the distance d2 between the signal contacts 34 and 44 and the conductor plates 32*a* and 42*a*, etc, impedance matching can be effected.

In addition, the ground contacts 33 and 43 need be located only on opposite sides of the series array of signal contacts 34 and 44. Although the distances between the ground contacts 33 and 43 and the signal contacts 34 and 44 varies, as the conductor plates 32*a* and 42*a* extends adjacent the signal contacts 34 and 44, differences in transmission signal delays passing through different signal contacts 34 and 44 can be avoided.

In the second example of the invention shown in FIGS. 8–12, parts corresponding with those of the first example are indicated by primed reference numerals and will not therefore be described in detail.

The main differences from the first example are that, in the second example, the signal contacts 34' and 44' are arranged in two rows; the base or board assembly 42' is formed from five conductor plates 42*a'* and four dielectric 42*b'*; and, the housings 31' and 41' are made of metal, except for an insulating lid part 41*a'*.

Electrically conducting layers are also formed in the peripheral side surfaces of the base or board assemblies 32' and 42' so that the edges of the respective conductor plates 32*a'* and 42*a'* engage the inner surfaces of the housings 31' and 41' thereby being electrically connected thereto.

When the connectors 30' and 40' are mated, all of the signal pins 34' and 44' are completely enclosed in the housings 31' and 41' and sealed under the housings 31' and 41' providing ground shields in similar fashion to the ground contacts of the first example. A reduction in cross-talk with high-speed signal transmission, avoidance of skew, close density pitch of the signal contacts affording miniaturization and, impedance matching accrue to the second example of connector.

I claim:

1. A high frequency electrical connector assembly comprising:

first and second intermatable connectors including first and second housings, respectively, having complementary front mating faces for movement together in a mating direction into mating engagement, first and second board assemblies mounted in the first and second housings, respectively, and each comprising a series of conductive and insulating dielectric layers located alternately in overlying relation and extending transversely of the mating direction, first and second, intermatable ground contact means extending between and interconnecting all the conductive layers of respective board assemblies thereby forming ground planes, and, a first and second series of signal contacts having complementary mating portions and anchoring portions extending through the respective board assemblies with the complementary mating portions at the mating faces and the respective conductive layers extending to locations adjacent and spaced from the anchoring portions so that mating portions of the connector assembly are shieldingly enclosed between the board assemblies when the connectors are assembled together.

2. A high frequency electrical connector according to claim 1 in which the conductive layers form outermost, front and rear layers of the board assemblies.

3. A high frequency electrical connector according to claim 1 in which the first and second ground contact means have respective conductive layer contacting portions anchored in the first and second board assemblies, respectively and matable male and female portions at respective mating faces.

4. A high frequency electrical connector according to claim 1 in which the ground contact means are located on the board assembly only on opposite transverse sides of the signal contacts.

5. A high frequency electrical connector according to claim 1 in which the ground contact means includes a conductive layer covering peripheral side edges of the board assemblies thereby interconnecting the conducting layers of the board assemblies.

6. A high frequency electrical connector according to claim 1 in which at least one of the first and second connectors has a rear, printed circuit board mounting face and at least some of the signal contacts of said at least one of the first and second connectors have printed circuit board engaging portions extending to the printed circuit board mounting face.

7. A high frequency electrical connector according to claim 6 in which at least one of the housings has an insulating cover overlying the outermost conductive layer at the mating face.

8. A high frequency electrical connector according to claim 1 in which the ground contact means includes the first and second housings having portions of conductive material extending rearwardly from mating faces around peripheral side edges of respective board assemblies in electrical contact with respective conductive layers thereof to provide a ground shielding layer.

9. A high frequency electrical connector according to claim 8 in which one housing has portions extending forwardly at the mating face which together with said rearwardly extending portions are made of conductive material.

10. A high frequency electrical connector according to claim 9 in which at least one of the housings has an insulating cover overlying the outermost conductive layer at the mating face.

* * * * *